United States Patent [19]

Nitschneider et al.

[11] 4,171,121

[45] Oct. 16, 1979

[54] STAPLE REMOVING APPARATUS

[75] Inventors: Robert M. Nitschneider, Cary; John R. Sargis; Martin Abrams, both of Chicago, all of Ill.

[73] Assignee: AES Technology Systems, Inc., Elk Grove Village, Ill.

[21] Appl. No.: 895,774

[22] Filed: Apr. 12, 1978

Related U.S. Application Data

[62] Division of Ser. No. 760,916, Jan. 21, 1977, Pat. No. 4,090,690.

[51] Int. Cl.[2] ..... B25C 11/00

[52] U.S. Cl. ..... 254/28

[58] Field of Search ..... 254/28; 100/155, 161-176; 29/125

[56] References Cited

U.S. PATENT DOCUMENTS

| | | | |
|---|---|---|---|
| 1,629,681 | 5/1927 | Cram | 100/173 X |
| 3,088,189 | 5/1963 | Johnston | 29/125 |
| 3,126,195 | 3/1964 | Taylor | 254/28 |
| 3,566,773 | 3/1971 | Chadwick | 100/169 |

FOREIGN PATENT DOCUMENTS

| | | | |
|---|---|---|---|
| 599508 | 6/1925 | France | 29/125 |

*Primary Examiner*—Robert C. Watson

*Attorney, Agent, or Firm*—Dressler, Goldsmith, Clement, Gordon & Shore, Ltd.

[57] ABSTRACT

Apparatus for removing staples by effecting displacement thereof through documents to effect separation of the staple from the documents.

3 Claims, 8 Drawing Figures

STAPLE REMOVING APPARATUS

This is a division, of application Ser. No. 760,916, filed Jan. 21, 1977 now U.S. Pat. No. 4,090,690.

BACKGROUND OF THE INVENTION

The present invention is directed to staple removing methods and apparatus and more particularly to a method and apparatus for disengaging staples from documents bound together by the staples.

While there exists a variety of staple removing devices and mechanisms, none adequately resolves the problem faced by many facilities which must process large numbers of documents with the attendant necessity of removing staples therefrom.

The most familiar of the staple removers is the manually operated claw-like device disclosed in U.S. Pat. No. 2,033,050. Other manual staple removing devices do exist, such as a lever which is slid under the crown of the staple for the purpose of prying the staple from the document. While these devices are adequate for low volume manual staple removal, they do not solve the problems faced by large volume commercial document processing facilities.

While these deficiencies have been appreciated, the various approaches, and attempts to provide apparatus for high volume automatic staple removal have been highly complex and not particularly successful. Most of these apparatus utilize the staple pulling technique, such as are illustrated in U.S. Pat. Nos. 3,126,195 and 3,528,643.

One problem with such apparatus and mechanisms is that in order to pull a staple it is necessary to find it. If staples were always in the same position and orientation on documents such devices might operate quite satisfactorily. It needs no long dissertation to appreciate that documents are rarely stapled together at identical locations, although some automatic machines may be able to achieve this result. However, most documents have not been stapled together by such automatic staplers, and staples may be located almost anywhere.

British Pat. No. 1,025,210 discloses another approach in an attempt to overcome this problem. In the British patent, the stapled documents are placed between two conductive members which are closed on the metallic staple. An electric current is then passed between the electrodes through the staple to effect separation of portions of the staple through which the current passes. As disclosed in said British patent, the staple must still be properly positioned between the electrodes so that electrical contact can be made. In addition, the apparatus disclosed in the British patent requires complex and/or expensive mechanical, hydraulic and electrical components.

The deficiencies of all these mechanisms suggests that an apparatus and method for rapidly and automatically separating staples from a plurality of stapled documents with a minimum of effort and without the necessity of precisely positioning and locating the staple would be highly desirable.

SUMMARY OF THE INVENTION

In accordance with the present invention there is provided a method and apparatus for inexpensively, rapidly, and simply effecting removal and separation of a staple from a plurality of documents bound together by the staple.

The method and apparatus incorporating the present invention are simple, reliable, relatively inexpensive and have particular utility and application for those environments in which a large number of documents are being processed, although they find application in almost any environment.

Removal of a staple in accordance with the present invention is achieved simply by effecting movement of the portions of the staple located on opposite sides of the documents into and through the documents to sever the staple from the documents. In effect, as the staple is moved into and through the documents, it acts as its own "knife blade" cutting the document. As a result, the staple becomes separated from the documents.

One of the advantages of this technique is that it does not require locating the staple in order to remove it. Thus, staples may be removed utilizing the method and apparatus of the present invention simply by passing the entire document through a mechanism which effects the desired movement of the staple, wherever located, through the documents.

More specifically, staple removal in accordance with the method of the present invention involves moving at least one exposed portion of the staple from one side of the documents into and through the documents to cause the staple to sever the documents and separate itself from the documents.

Movement of the staple through the documents may be effected by disposing the stapled portion of the document between a pair of hard, rigid members and applying a force to these members to effect the desired movement of the staple into and through the documents stapled together.

Movement of the staple can take place in various ways. For example, as the force is applied to both sides of the documents, the staple typically tends to rotate so that both the exposed portions are pressed into and pass through the documents bound together along different paths. It may be, however, that only one of the exposed portions of the staple passes through the documents; or alternatively, both of the exposed staple portions pass through the documents towards each other in the same plane. In some of these cases, portions of the staple may pass through only some of the documents until they contact each other.

Apparatus incorporating the present invention may take advantage of the fact that precise location of the staple is not necessary. Thus, in one embodiment of an apparatus incorporating the present invention, a pair of rigid rollers, defining a nip therebetween, are utilized to effect staple removal. In this embodiment, a stapled document is passed between the rollers. As each staple passes through the nip, the desired severance of the staple from the documents is effected.

Another advantage of the present apparatus is that selective staple removal may be achieved quickly and conveniently. In many documents, attachments are stapled to the document in the same area, although the staples may not be in the same place from document to document. One of the rollers may extend only over a partial length of the document so that staples pass through the nip between the rollers only in a desired selected location. Thus, only staples in that area would be subjected to the necessary force to effect the movement through the documents and the desired severance and removal.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

Figure 2:
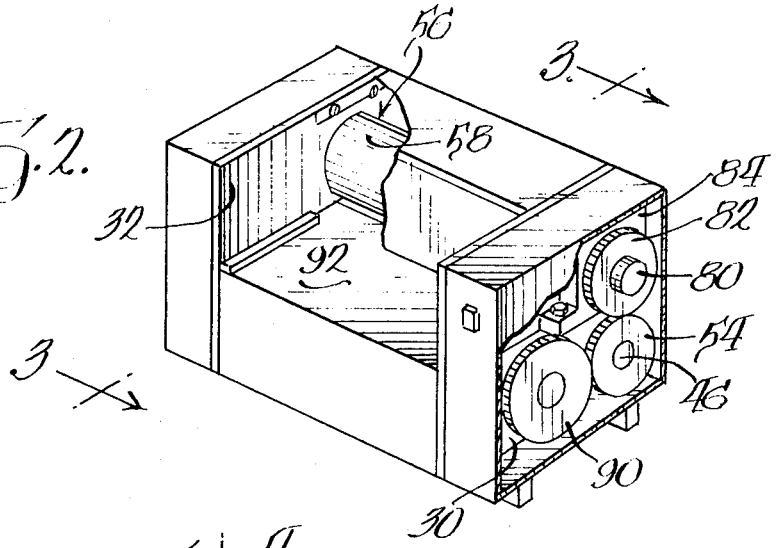
FIG. 2 shows one embodiment of an apparatus for effecting staple removal.
Figure 3:
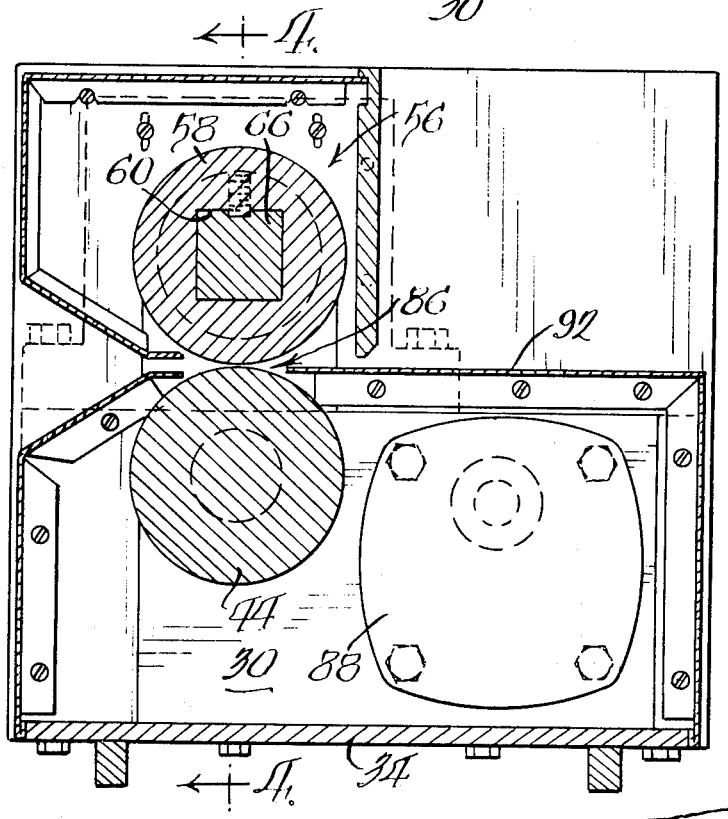
FIG. 3 is a sectional view taken along lines 3—3 of FIG. 4.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

Figure 1:
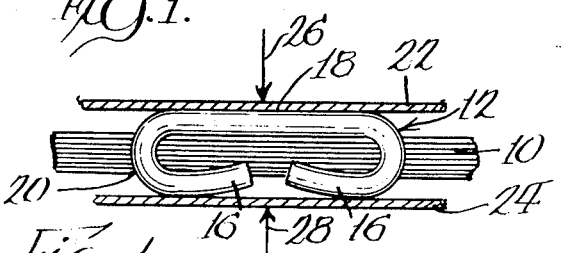
FIG. 1 is a diagrammatic view showing a plurality of documents stapled together with members for effecting removal of the staple.

FIG. 1 shows a plurality of documents 10 bound together by a staple 12. While for convenience, reference will be made to documents throughout this application, it should be understood that the term "document" may encompass any variety of sheet material capable of being bound together by a fastener such as a staple.

The staple 12 comprises a looped length of wire bent and formed with two end portions 16 which are driven into the documents and clinched to the underside thereof to bind the documents togehter. The clinched staple includes a crown portion 18 which typically lies on the surface of the document which will be described as the top surface; bent portions 20 which pass through the documents 10; and the end portions 16 which are clinched against the bottom surface of the documents.

Figure 1A:
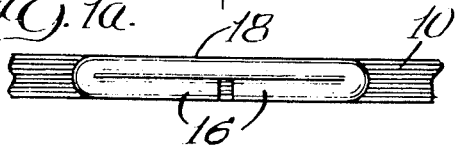
FIG. 1*a* is similar to FIG. 1 showing the position of a staple after movement through the documents.

As shown in FIGS. 1 and 1*a*, removal of the staple 12 in accordance with the method and apparatus of the present invention is achieved by effecting movement of the staple 12 into and through the documents 10. Movement of the staple 12 through the documents 10 may be achieved by effecting reorientation of the staple, causing it to tend to rotate and then applying sufficient force to effect passage of the exposed elements, the crown 18 and end portions 16, into and through the documents 10 (See FIG. 7). Alternatively, the staple can be deformed with the end portions 16 and crown portion 18 remaining substantially in the same plane and passing through only portions of the documents 10 until they come into contact with each other, as shown in FIG. 1*a*. Such movement of the staple into and through the documents may be achieved quite simply by use of a pair of pressure members 22, 24 disposed on opposite sides of the documents 10. When a force, indicated by arrows 26, 28 is applied to the members 22, 24, the staple 12 is pushed into and through the documents 10.

One of the advantages of the method of the present invention is that it may be incorporated into a relatively simple apparatus which can be adapted for high volume, rapid staple removal.

One embodiment of such an apparatus is shown in FIGS. 2–5. The apparatus comprises a pair of supporting frame members 30, 32 which are supported on a bottom 34. Each of the supporting members 30, 32 includes a pair of apertures 36, 38, 40, 42. Apertures 36, 38 are aligned with apertures 40, 42, respectively.

A first, cylindrical lower roller 44 has a pair of shaft extensions 46, 48 formed at either end thereof. The extensions 46, 48 pass through the lower pair of axially aligned apertures 36, 40 in the support members 30, 32, respectively. The roller extensions 46, 48 are each journalled in suitable bearings 50, 52, each supported in one of the support member apertures 36, 40. A drive gear 54 is affixed to the end of one of the shaft extensions 46 for effecting rotation of the roller 44 as described below.

The other or upper roller 56 comprises a plurality of roller segments 58, each formed with a non-circular aperture 60 passing axially therethrough, shown in the drawings as a square aperture. Each of the roller segments 58 is provided at one end with an axial extension 62 having a radial dimension less than the dimension of the roller segment 58. A set screw 64 is threaded in the axial extension 62 to lock the roller segment 58 to a square shaft 66 which slidably receives each of the roller segments 58. The other end of each of the roller segments 58 includes an axial recess 68 adapted to receive a corresponding extension 62 of an adjacent roller segment 58.

One end of the square shaft 66 is slidably supported by an annular collar 70 having a bore 72 conforming in shape to the shape of the shaft 66. The collar 70 is journalled in a suitable bearing 74 affixed to the support member 32. The other end of the square shaft 66 is supported by a drive collar 76 formed with a closed axial bore 78 also conforming in shape to the shape of the shaft 66. The drive collar 76 has a shaft extension 80 on which is affixed a drive gear 82 which engages the drive gear 54 affixed to the lower roller shaft extension 46 for transmission of power thereto. The drive collar 76 is also suitably journalled in a bearing 84 affixed to the other support member 30.

Figure 6:
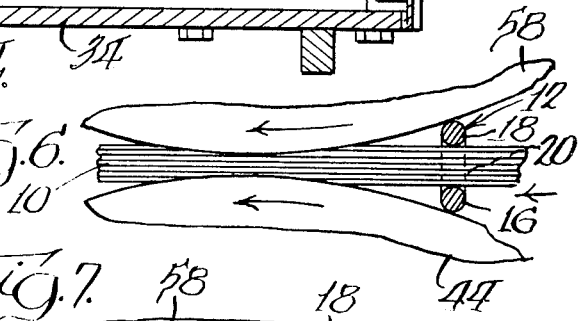
FIGS. 6 and 7 are enlarged diagrammatic views showing how the apparatus incorporating the present invention effects staple removal.
Figure 7:
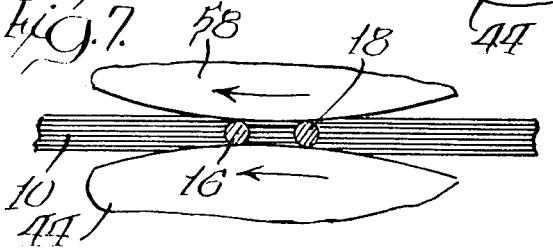
Figure 4:
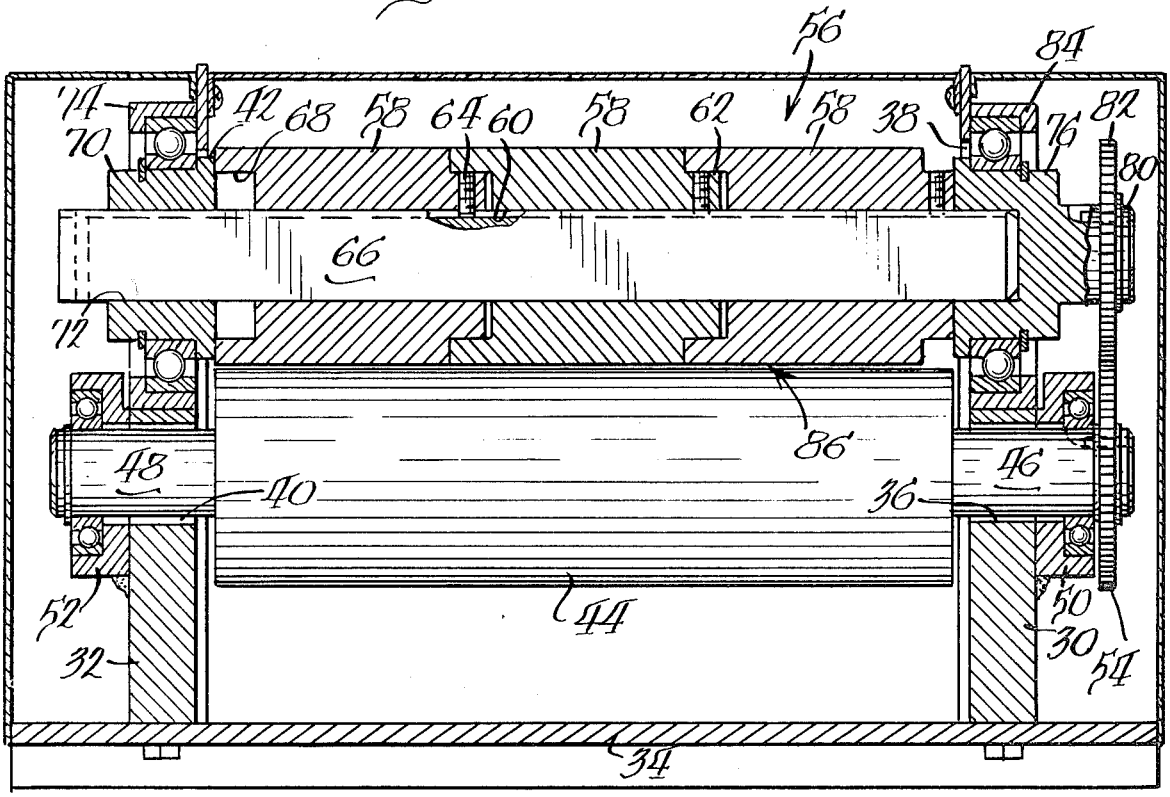
FIG. 4 is a sectional view taken along lines 4—4 of FIG. 3.

The two rollers, the lower roller 44 and the upper roller 56 comprised of the square shaft 66 and a selected number of roller segments 58, are supported in the support members to define a nip 86 therebetween. The adjacent surfaces of the rollers 44, 56 are spaced from each other a sufficient distance apart to permit ready passage of documents 10 therebetween. At the same time the space or gap 86 between the rollers is sufficiently small that a staple 12 passing therethrough is forced to move into and through the documents 10 as shown in FIGS. 6 and 7.

The rollers 44, 56 are driven by any suitable source of power such as an electric motor 88. The motor shaft has affixed thereto a drive gear 90 engaged with the lower roller drive gear 54 to effect relative rotation of the rollers 44, 56 in opposite directions.

The housing for the staple remover defines a document support shelf 92 aligned with the nip 86 between the rollers 44, 56. Documents fed onto the document support shelf 92 are introduced to the nip 86 between the rollers 44, 56. The rollers advance the documents 10 therethrough to effect the desired movement of the staple 12 into and through the documents 10 with the resultant separation thereof.

Figure 5:
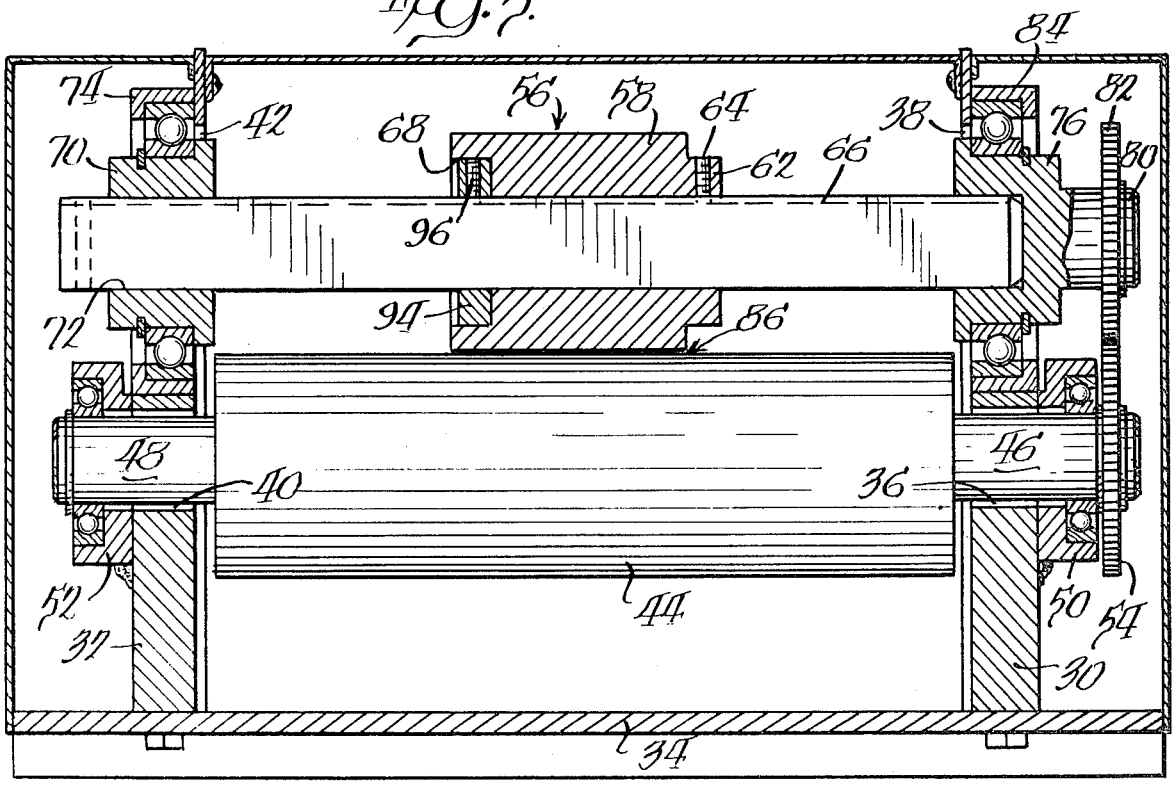
FIG. 5 is a sectional view similar to FIG. 4 showing the apparatus configured for selective staple removal.

Advantageously, the staple remover incorporating the present invention may be utilized to remove staples from only selected areas of a document. Thus, as shown in FIG. 5, if staples are only desired to be removed from one area of documents, only one of the upper roller segments 58 is placed on the square roller shaft 66. In FIG. 5, the apparatus has been set to remove staples from only the center area of documents introduced into the staple remover. A single roller segment 58 is disposed on the shaft 66 along with a positioning ring 94. The positioning ring 94 includes a set screw 96 for locking the ring 94 to the shaft 66 at a desired location. The roller segment 58 is then slid over the positioning ring and the set screw 64 in the axial extension 62 is tightened to lock the roller segment 58 in place.

Thus, any document introduced into the staple remover configured as shown in FIG. 5 could have staples removed only from the center portion thereof. Staples on either side of the roller segment 58 will, of course, not be subjected to any compressive force, and will not be removed.

Thus, there has been disclosed a method and apparatus for simply, rapidly, and efficiently effecting removal of staples from documents. The method and apparatus of the present invention removes staples simply by effecting movement of the staple from opposite sides of the document into and through the document to effect severence of the document to allow separation therebetween.

The method and apparatus of the present invention effects such removal of staples without requiring the necessity of locating the specific position of the staple; and apparatus incorporating the present invention may be arranged to remove staples only from selected areas thereof when, for example, only attachments to the document are desired to be removed.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. Apparatus for disengaging staples in a plurality of documents retained together by a staple comprised of a loop of wire bent and formed with two points driven through the documents and clinched to bind the documents together comprising:

a pair of rotatable force applying members defining a nip therebetween, one of said members being a cylinder affixed to a shaft;

means for rotatably supporting said shaft;

means for rigidly supporting said members in a spaced apart relation with the space between the members being approximately equal to the thickness of the staple wire;

means for rotating said members in opposite directions;

means connecting said rotating means to said shaft for effecting rotation of said cylinder;

non-circular shaft means;

collar means rotatably supported in said apparatus having shaft receiving means shaped complementary to said shaft means for slidably receiving said shaft means;

a roller member slidably received on said shaft means and rotatable therewith, said roller member having an axial dimension less than the axial dimension of said shaft means;

means for locking said roller member to said shaft means at a selected axial position, said locking means including an axial extension formed at one end of said roller member having a diameter less than the diameter of said roller member, and means in said extension for locking said roller member to said shaft;

the opposite end of said roller member from said extension being formed with an axial recess adapted to slidably receive an extension on an adjacent roller member;

whereby a stapled document introduced into the nip between said rotatable members is pulled therethrough and said staple is displaced through said documents to sever itself from said documents.

2. An apparatus as claimed in claim 1 comprising:

a plurality of said roller members slidably received on said shaft, the axial extensions on selected ones of said roller members disposed within the axial recesses in adjacent ones of said members whereby the surfaces of said rollers define a generally continuous roller, said rollers being disposed at selected axial positions along said shaft.

3. An apparatus as claimed in claim 2, including:

motor means for driving said roller and said shaft with said roller members affixed thereto, and means connecting said motor means to said roller and to said shaft to effect rotation thereof in opposite directions.

* * * * *